US006729842B2

(12) United States Patent
Drerup et al.

(10) Patent No.: US 6,729,842 B2
(45) Date of Patent: May 4, 2004

(54) METHODS AND APPARATUS TO REDUCE SEAL RUBBING WITHIN GAS TURBINE ENGINES

(75) Inventors: Vincent M. Drerup, Cincinnati, OH (US); Ronald Galley, Mason, OH (US); David E. Budinger, Loveland, OH (US); Mariusz P. Staszak, Warsaw (PL); Ching-Pang Lee, Cincinnati, OH (US); Richard W. Albrecht, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/229,874

(22) Filed: Aug. 28, 2002

(65) Prior Publication Data

US 2004/0042898 A1 Mar. 4, 2004

(51) Int. Cl.[7] ..... F01D 11/00

(52) U.S. Cl. ..... 415/173.7; 416/198 A; 277/53; 29/889.2

(58) Field of Search ..... 415/173.7, 174.4, 415/174.5, 230; 146/198 A, 201 R; 277/53, 26, 9; 29/889.1, 889.12, 889.2, 889.21

(56) References Cited

U.S. PATENT DOCUMENTS 3,807,891 A * 4/1974 McDow et al. ..... 415/116
3,965,066 A 6/1976 Sterman et al.
4,008,568 A 2/1977 Spears, Jr. et al.
4,309,145 A * 1/1982 Viola ..... 415/170 R
4,645,424 A * 2/1987 Peters ..... 416/198
4,767,267 A * 8/1988 Salt et al. ..... 415/174
4,815,933 A 3/1989 Hansel et al.
4,883,405 A 11/1989 Walker
4,951,973 A 8/1990 Corsmeier
5,249,920 A 10/1993 Shepherd et al.
5,271,714 A 12/1993 Shepherd et al.
5,343,694 A 9/1994 Toborg et al.
5,398,496 A 3/1995 Taylor et al.
5,470,198 A 11/1995 Harrogate et al.
5,526,640 A 6/1996 Brooks et al.

* cited by examiner

*Primary Examiner*—Edward K. Look
*Assistant Examiner*—J. M. McAleenan
(74) *Attorney, Agent, or Firm*—William Scott Andes; Armstrong Teasdale LLP; Robert B. Reeser, III

(57) ABSTRACT

A method enables a nozzle assembly for a gas turbine engine rotor assembly to be fabricated. The rotor assembly includes at least two adjacent rows of rotor blades coupled together by a disk spacer arm. The method includes providing a nozzle assembly that includes at least one nozzle including a vane that extends outwardly from a radially outer side of an inner band, coupling the nozzle assembly into the rotor assembly between the two adjacent rows of rotor blades, and coupling a seal assembly that includes a backing piece to the nozzle assembly such that the backing piece is substantially parallel to the rotor assembly disk spacer arm.

19 Claims, 6 Drawing Sheets

METHODS AND APPARATUS TO REDUCE SEAL RUBBING WITHIN GAS TURBINE ENGINES

BACKGROUND OF THE INVENTION

This invention relates generally to gas turbine engines, and more specifically to nozzle assemblies used with gas turbine engines.

At least some known gas turbine engines include a core engine having, in serial flow arrangement, a fan assembly and a high pressure compressor which compress airflow entering the engine, a combustor ignites a fuel-air mixture which is then channeled through a turbine nozzle assembly towards low and high pressure turbines which each include a plurality of rotor blades that extract rotational energy from airflow exiting the combustor.

The turbine nozzle assemblies are positioned between adjacent rows of rotor blades and channel airflow downstream towards the rotor blades. More specifically, in at least some known rotor assemblies, the turbine nozzle assemblies are radially outward from a disk spacer arm that separates adjacent rows of rotor blades. Each nozzle assembly includes a nozzle vane that is coupled to casing surrounding the rotor assembly, and extends outwardly from a inner band. An interstage seal assembly is coupled to the inner band with a nozzle flange. At least some known interstage seal assemblies include a honeycomb seal that is brazed to a backing sheet that is coupled to the nozzle flange.

During engine operation, turbine overseers may cause a rotor shaft coupled to the fan assembly to separate. The shaft separation may cause the rotor assembly to shift aftward such that the disk spacer arm may contact the seal assemblies. Over time, continued operation of the rotor assembly may cause the backing plate and/or the brazing material to cut through the disk spacer arm in an undesirable condition known as a disk burst.

To facilitate preventing disk bursts, at least some known gas turbine engines have been retrofitted by replacing the existing seal assemblies with a redesigned seal assembly that is positioned more downstream than the existing seal assemblies. Such retrofits are labor-intensive and may be costly.

BRIEF SUMMARY OF THE INVENTION

In one aspect a method for fabricating a nozzle assembly for a gas turbine engine rotor assembly is provided. The rotor assembly includes at least two adjacent rows of rotor blades coupled together by a disk spacer arm. The method comprises providing a nozzle assembly that includes at least one nozzle including a vane that extends outwardly from a radially outer side of an inner band, coupling the nozzle assembly into the rotor assembly between the two adjacent rows of rotor blades, and coupling a seal assembly that includes a backing piece to the nozzle assembly such that the backing piece is substantially parallel to the rotor assembly disk spacer arm.

In another aspect, a rotor assembly for a gas turbine engine is provided. The rotor assembly includes a rotor and a nozzle assembly. The rotor assembly includes a rotor including a rotor shaft and a plurality of rows of rotor blades, wherein adjacent rows of rotor blades are coupled by a disk spacer arm. The nozzle assembly extends between adjacent rows of the plurality of rotor blades. Each nozzle assembly includes a nozzle including a vane extending outwardly from an inner band, and an interstage seal assembly. Each seal assembly is coupled to the nozzle inner band and includes a backing piece. The backing piece is substantially parallel to the disk spacer arm.

In a further aspect of the invention, a gas turbine engine comprising at least one turbine including a rotor assembly and a nozzle assembly is provided. The rotor assembly includes a rotor shaft and at least two adjacent of rows of rotor blades coupled by a disk spacer arm. The nozzle assembly is between the adjacent rows of rotor blades, and includes a nozzle including a vane extending outwardly from an inner band, and a seal sub-assembly. The seal sub-assembly includes a backing piece coupled to the nozzle inner band such that the backing piece is substantially parallel to the disk spacer arm.

DETAILED DESCRIPTION OF THE INVENTION

Figure 1:
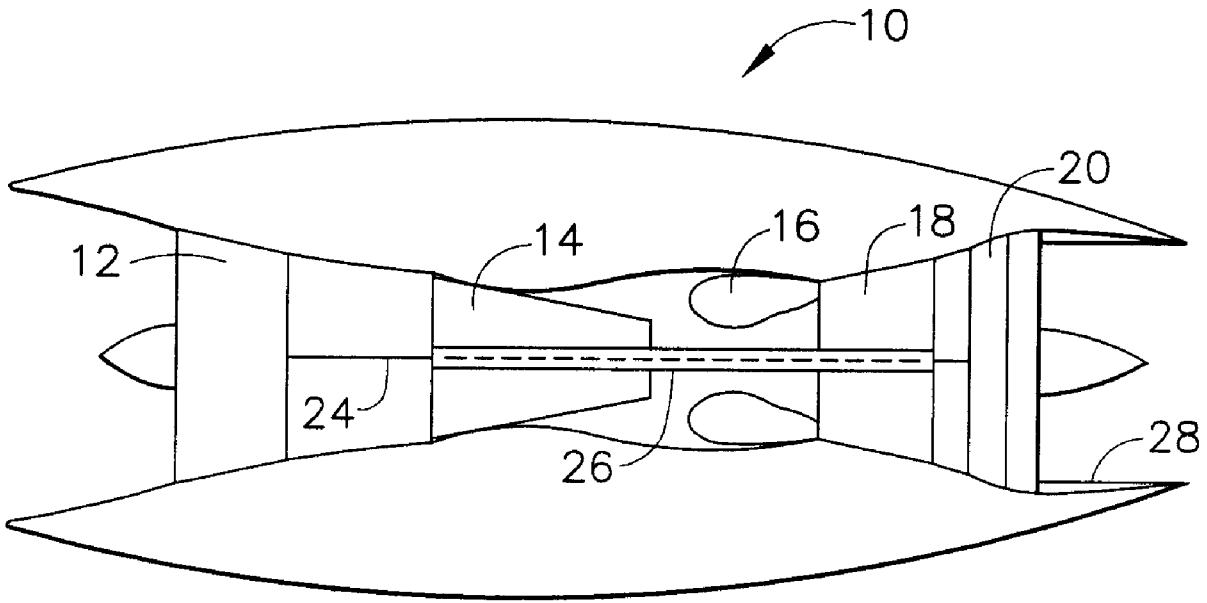
FIG. 1 is schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Compressor 12 and turbine 20 are coupled by a first shaft 24, and compressor 14 and turbine 18 are coupled by a second shaft 26. In one embodiment, the gas turbine engine is a GE90 available from General Electric Company, Cincinnati, Ohio.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 before exiting gas turbine engine 10.

Figure 2:
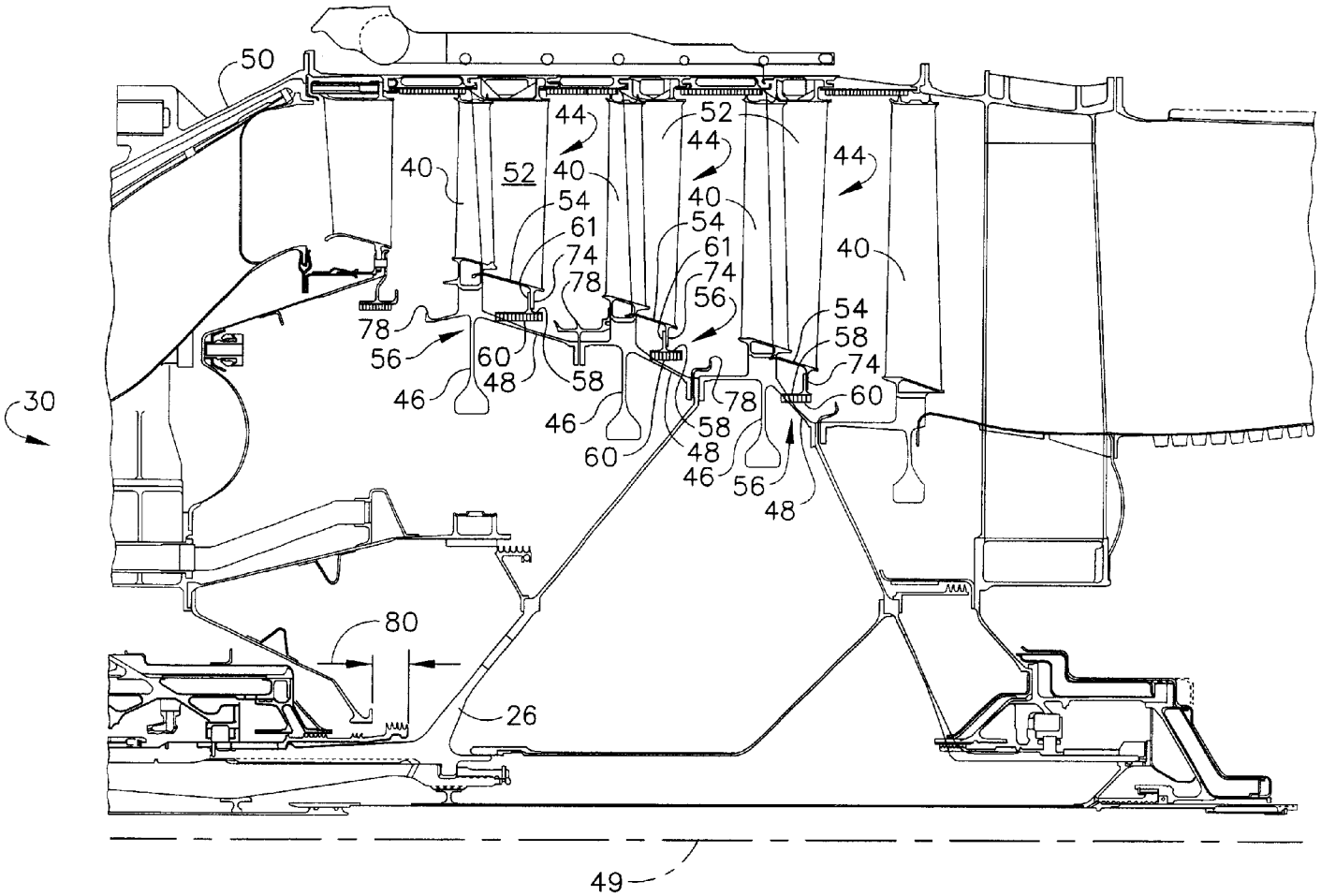
FIG. 2 is partial schematic view of a known gas turbine engine rotor assembly shown following a shaft separation.

FIG. 2 is partial enlarged schematic view of a known rotor assembly 30, such as used within turbine 20 (shown in FIG. 1), shown positioned aftward following a shaft 24 separation. Rotor assembly 30 includes a plurality of stages, and each stage includes a row of rotor blades 40 and a row of turbine nozzle assemblies 44. In the exemplary embodiment, rotor blades 40 are supported by rotor disks 46 and are coupled to rotor shaft 26. A disk spacer arm 48 extends between adjacent rows of blades 40. More specifically, each disk spacer arm 48 is oblique with respect to a centerline 49 extending through engine 10. Rotor assembly 30 is surrounded by a casing 50 that extends circumferentially around assembly 30 and supports nozzle assemblies 44.

Nozzle assemblies 44 each include a vane 52 that extends substantially perpendicularly from a nozzle inner band 54. More specifically, inner band 54 extends between vane 52 and a respective seal assembly 56. In the exemplary embodiment, rotor assembly 30 is used with a low pressure turbine, and seal sub-assembly 56 is an interstage seal assembly. More specifically, each seal sub-assembly 56 includes a backing plate 58 and a seal member 60 that is coupled to backing plate 58. Each backing plate 58 includes a coupling flange 61 that extends radially outwardly from each backing plate 58. Coupling flange 61 enables each seal sub-assembly 56 to be coupled with a plurality of fasteners (not shown in FIG. 2) to a nozzle flange 74 that extends from each nozzle inner band 54.

Each backing plate 58 is aligned substantially parallel to engine centerline 49 and each seal member 60 has a substantially rectangular cross-sectional profile. In one embodiment, seal member 60 is brazed to backing plate 58. Accordingly, when each seal member 60 is coupled to each respective backing plate 58, members 60 are each substantially parallel to engine centerline 49 to facilitate contacting seal teeth 78 that extend from a downstream rotor blade 40. More specifically, seal member 60 and teeth 78 facilitate preventing airflow from flowing around nozzle assemblies 44 rather than through nozzle assemblies 44.

As shown in FIG. 2, rotor assembly 30 has shifted aftward a distance 80 following a shaft separation of shaft 26. Such shaft separations may occur following a rotor overseers or a rotor speed burst. Other conditions, such as fan imbalances, may also cause shaft separation. After rotor assembly 30 has shifted aftward distance 80, each respective disk spacer arm 48 contacts each seal sub-assembly. Specifically, each disk spacer arm 48 undesirably contacts each respective seal member 60 and/or braze material used to couple seal member 60 to backing plate 58, following a shaft separation. Over time, continued contact between rotor assembly 30 and each backing plate 58 and/or the braze material may cause each seal member 60 to cut through each disk spacer arm 48 and result in a condition known as a disk burst.

Figure 3:
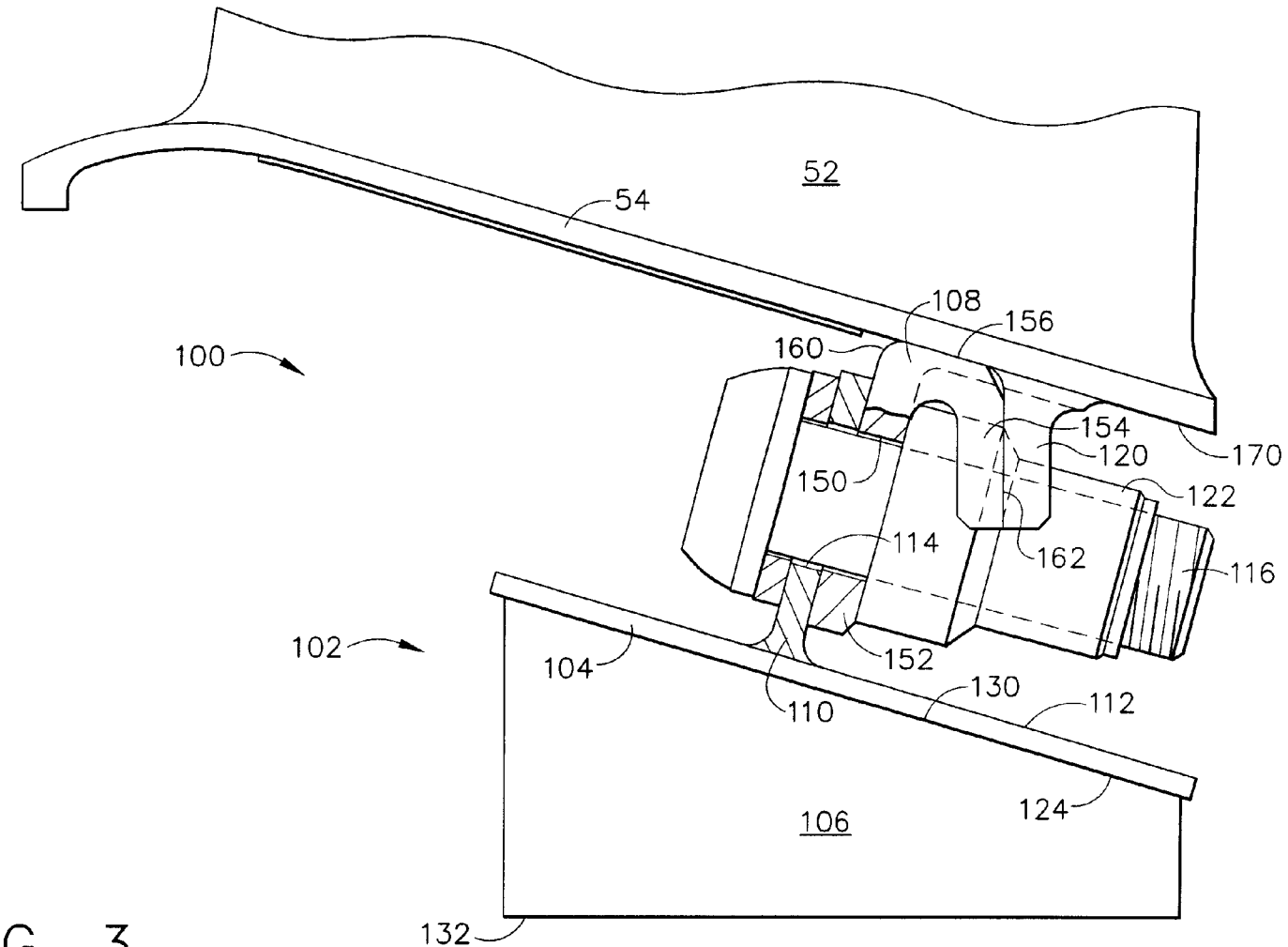
FIG. 3 is an enlarged partial schematic illustration of a nozzle assembly that may be used with the rotor assembly shown in FIG. 2.
Figure 4:
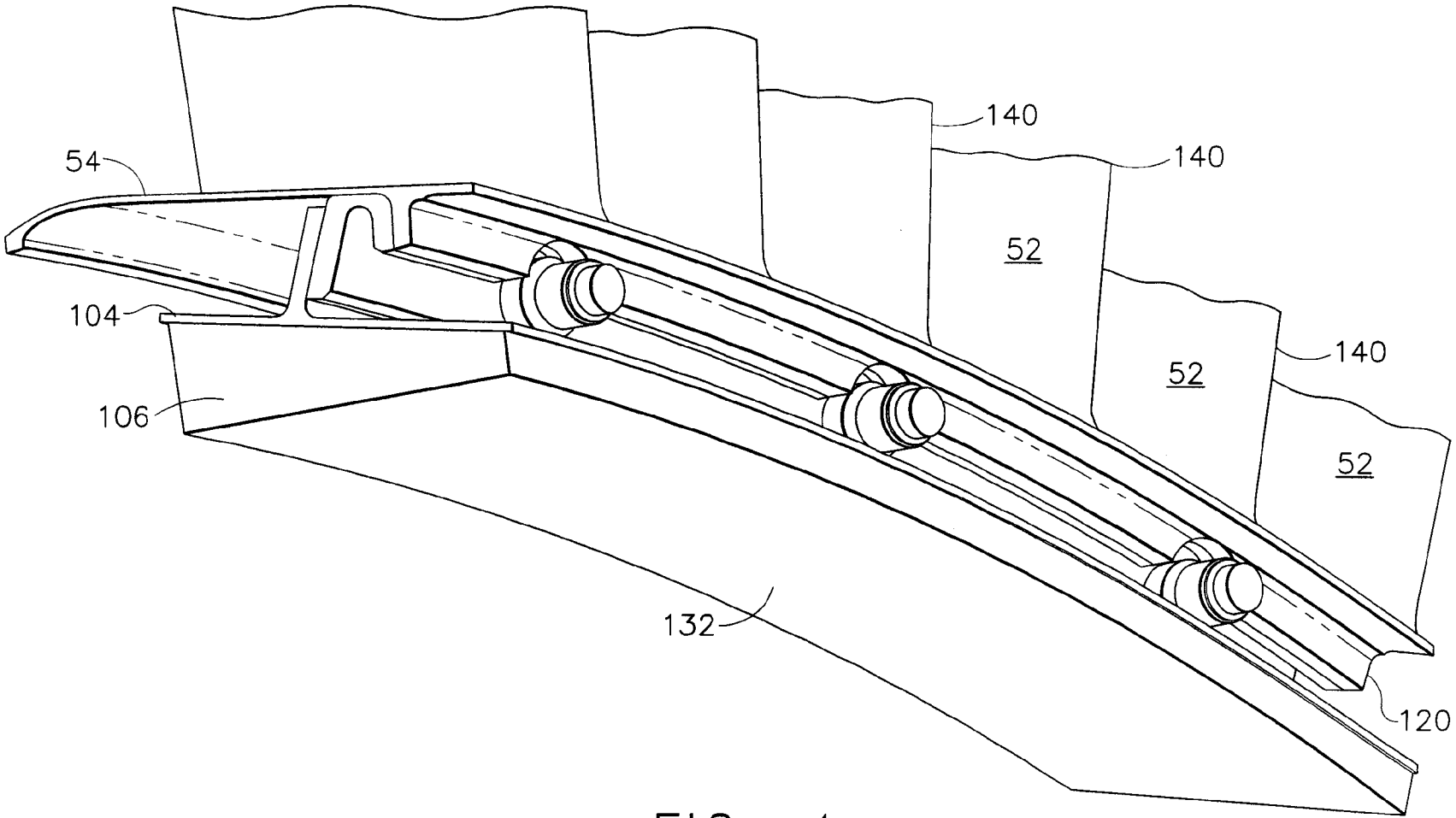
FIG. 4 is an enlarged partial perspective view of the nozzle assembly shown in FIG. 3.

FIG. 3 is an enlarged partial schematic illustration of a turbine nozzle assembly 100 that may be used with rotor assembly 30 (shown in FIG. 2). FIG. 4 is an enlarged partial perspective view of turbine nozzle assembly 100. Turbine nozzle assembly 100 includes a seal sub-assembly 102, nozzle vane 52, and nozzle inner band 54. Seal sub-assembly 102 includes a backing plate 104, a seal member 106, and a mounting flange 108.

Backing plate 104 is arcuate and includes a coupling flange 110 that extends substantially perpendicularly from a radially outer side 112 of backing plate 104. Coupling flange 110 includes a plurality of openings 114 that extend therethrough. Each flange opening 114 is sized to receive a fastener 116 therethrough for coupling backing plate 104 to a nozzle flange 120. In the exemplary embodiment, fastener 116 is a bolt that is secured by a nut 122.

Seal member 106 is attached to a radially inner side 124 of backing plate 104. In the exemplary embodiment, seal member 106 is brazed to backing plate 104. Backing plate inner side 124 is opposite backing plate outer side 102 and is substantially planar. In the exemplary embodiment, seal member 106 is a honeycomb material, such as Hastelloy X®. Seal member 106 is arcuate and includes a radially outer surface 130 and a radially inner surface 132. Radially outer surface 130 is disposed obliquely with respect to radially inner surface 132.

Nozzle flange 120 is substantially similar to nozzle flange 74 shown in FIG. 2, and includes a plurality of semi-circular recessed areas 140 defined therein. Recessed areas 140 enable nut 122 to be coupled to fastener 116. therethrough. More specifically, each area 140 enables fasteners 116 to secure seal sub-assembly 102 to nozzle assembly 100. More specifically, in one embodiment, nozzle flange 120 is fabricated by retrofitting existing nozzle flanges 74. Specifically, existing nozzle flange 74 includes a plurality of bosses or mounting tabs (not shown) that extend only circumferentially around each fastener opening (not shown) extending therethrough. In contrast, nozzle flange 120 does not include the mounting tabs or bosses, and rather only includes semi-circular recessed areas 140.

Mounting flange 108 is arcuate and includes a plurality of openings 150 extending therethrough. Each opening 150 is sized to receive fastener 116 therethrough. Flange 108 includes an upstream arm 152 and a downstream arm 154 connected by a base 156. Arms 152 and 154, and base 156 define a substantially U-shaped cross-sectional profile for flange 108. Flange 108 is coupled between nozzle flange 120 and backing plate coupling flange 110 such that an upstream surface 160 of upstream arm 152 is against coupling flange 110, a downstream surface 162 of downstream arm 154 is against nozzle flange 120, and base 156 is against a radially inner side 170 of nozzle inner band 54. More specifically, in the exemplary embodiment, mounting flange downstream arm 154 is brazed to nozzle flange 120, and mounting flange base 156 is brazed to nozzle inner band 54.

Accordingly, during assembly, seal member 106 is brazed to backing plate 104 such that seal member outer surface 130 is against backing plate inner side 124. Mounting flange 108 is then brazed to nozzle flange 120 such that mounting flange openings 150 are substantially concentrically aligned with respect to nozzle flange recesses 140. Mounting flange is also brazed to nozzle inner band 54, as described in more detail above, and backing plate 104 is then coupled to nozzle flange 120 with fasteners 116 which extend through backing plate openings 114 and mounting flange openings 150. Nuts 122 are coupled to fasteners 116 to secure backing plate 104 to nozzle flange 120. Specifically, when fully assembled, mounting flange 108 causes backing plate 104 to be secured to nozzle flange 120 such that backing plate 104 is not only mounted obliquely within engine 10 with respect to engine centerline 49 (shown in FIG. 2), but is also substantially parallel to disk spacer arm 48.

Although backing plate 104 is mounted obliquely within engine 10, because seal member outer surface 130 is oblique with respect to seal member inner surface 132, when seal member 106 is coupled to backing plate 104, seal member inner surface 132 is aligned substantially parallel to engine centerline 49, and as such, is engagable by seal teeth 78 (shown in FIG. 2) during normal engine operations. If a shaft separation does occur, because backing plate 104, and any brazing material used to couple seal member 106 to backing plate 104, is mounted substantially parallel to each disk spacer arm 48 (shown in FIG. 2), if rotor assembly 30 shifts aftward, seal sub-assembly 102 facilitates preventing disk spacer arm 48 from rotating against backing plate 104 or the brazing material. As such, seal sub-assembly 102 facilitates reducing engine disk bursts.

Furthermore, during engine retrofits, the same backing plate 58 and fasteners (not shown) used with seal sub-assembly 56 (shown in FIG. 2) may be utilized with seal sub-assembly 102. Furthermore, the same nozzle flange 74 could be used with nozzle assembly 100 if modified as described above. Accordingly, seal sub-assembly 102 facilitates reducing engine disk bursts in a cost-effective manner.

Figure 5:
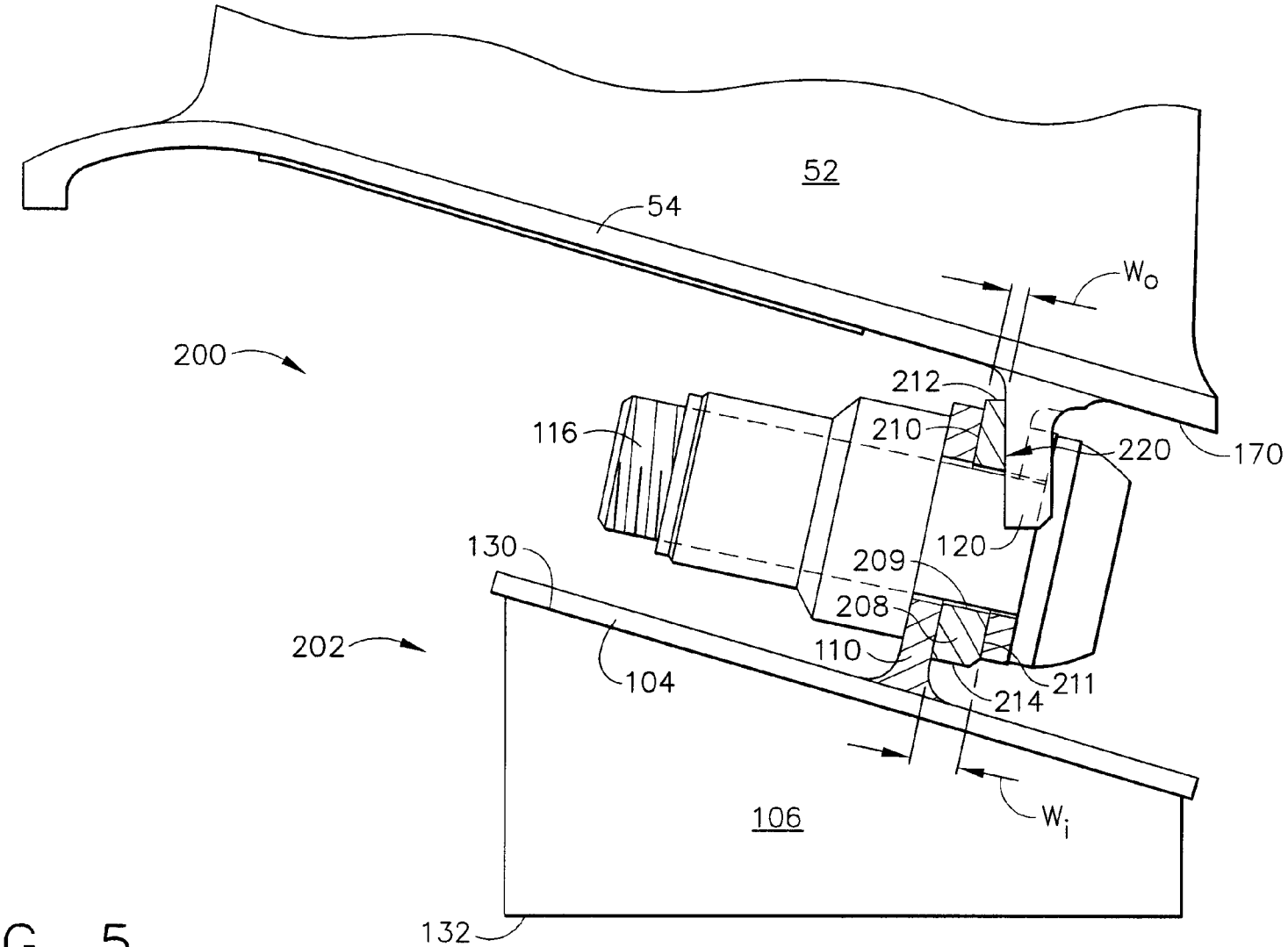
FIG. 5 is an enlarged partial schematic illustration of an alternative embodiment of a nozzle assembly that may be used with the rotor assembly shown in FIG. 2.
Figure 6:
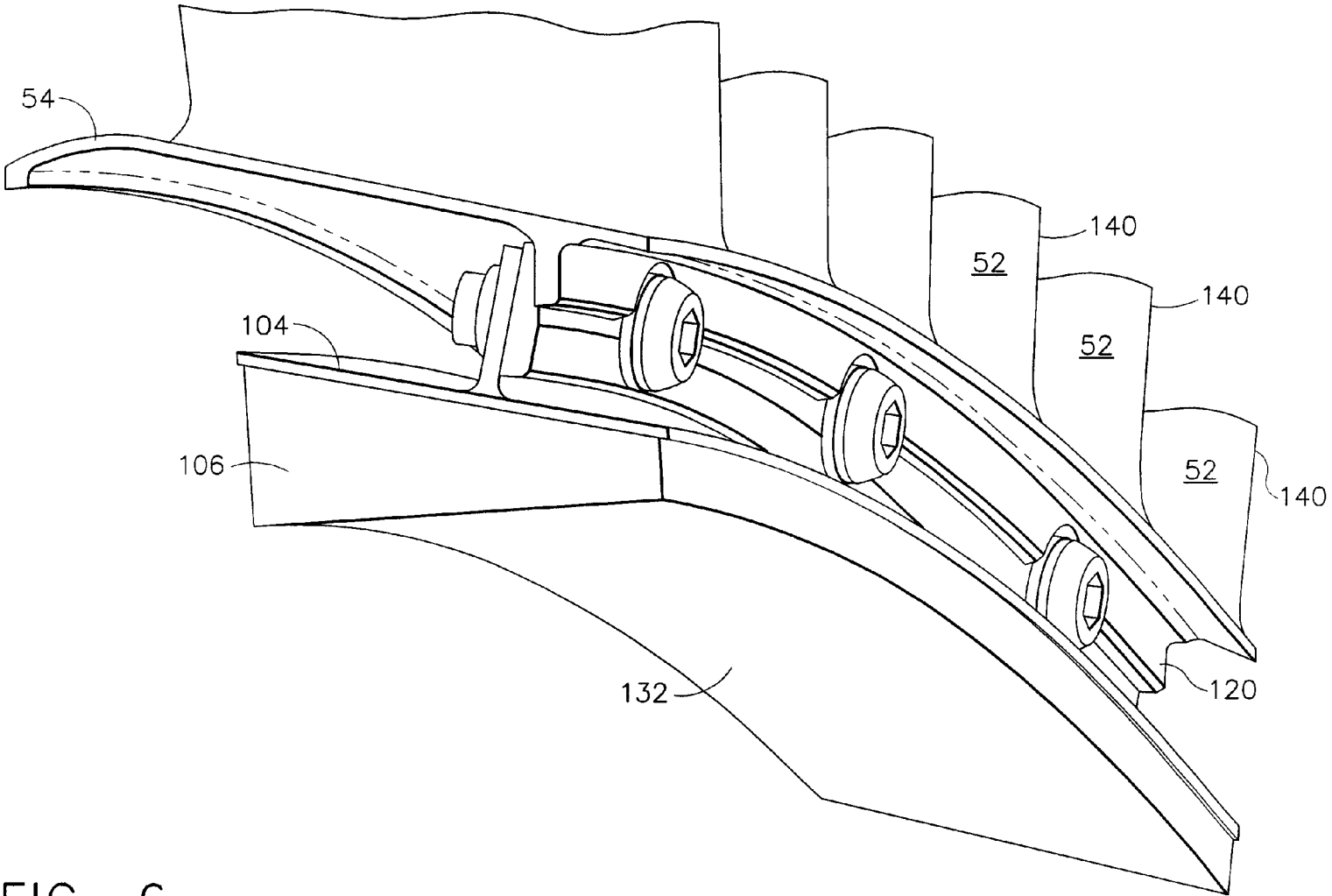
FIG. 6 is an enlarged partial perspective view of the nozzle assembly shown in FIG. 5.

FIG. 5 is an enlarged partial schematic illustration of an alternative embodiment of a nozzle assembly 200 that may be used with rotor assembly 30 (shown in FIG. 2). FIG. 6 is an enlarged partial perspective view of nozzle assembly 200.

Nozzle assembly 200 is substantially similar to nozzle assembly 100 (shown in FIGS. 3 and 4) and components of nozzle assembly 200 that are identical to components of nozzle assembly 100 are identified in FIGS. 5 and 6 using the same reference numerals used in FIGS. 3 and 4. Accordingly, nozzle assembly 200 includes a seal sub-assembly 202, nozzle vane 52, and nozzle inner band 54. Seal sub-assembly 202 includes backing plate 104, seal member 106, and a mounting flange 208.

Mounting flange 208 is arcuate and includes a plurality of openings 209 extending therethrough. Each opening 209 is sized to receive fastener 116 therethrough. Flange 208 includes a substantially planar upstream side 210 and an opposite downstream side 211 that are connected by a radially outer edge 212 and a radially inner edge 214. A radially outer portion 220 of flange downstream side 211 is tapered towards flange upstream side 210 such that a width $W_o$ of outer edge 212 is less than a $W_i$ of inner edge 214.

Flange 208 is coupled between nozzle flange 120 and backing plate coupling flange 110 such that flange downstream side portion 220 is against nozzle flange 120, and flange upstream side 210 is against coupling flange 110. More specifically, in the exemplary embodiment, mounting flange downstream side portion 220 is brazed to nozzle flange 120.

During assembly, seal member 106 is brazed to backing plate 104 such that seal member outer surface 130 is against backing plate inner side 124. Mounting flange 208 is then brazed to nozzle flange 120 such that mounting flange openings 209 are substantially concentrically aligned with respect to nozzle flange recesses 140, and backing plate 104 is then coupled to nozzle flange 120 with fasteners 116 which extend through backing plate openings 114 and mounting flange openings 209. Nuts 122 are coupled to fasteners 116 to secure backing plate 104 to nozzle flange 120. Specifically, when fully assembled, mounting flange 208 causes backing plate 104 to be secured to nozzle flange 120 such that backing plate 104 is not only mounted obliquely within engine 10 with respect to engine centerline 49 (shown in FIG. 2), but is also substantially parallel to disk spacer arm 48 (shown in FIG. 2).

Although backing plate 104 is mounted obliquely within engine 10, because seal member outer surface 130 is oblique with respect to seal member inner surface 132, when seal member 106 is coupled to backing plate 104, seal member inner surface 132 is aligned substantially parallel to engine centerline 49, and as such, is engageable by seal teeth 78 (shown in FIG. 2) during normal engine operations. If a shaft separation does occur, because backing plate 104, and any brazing material used to couple seal member 106 to backing plate 104, is mounted substantially parallel to each disk spacer arm 48, if rotor assembly 30 shifts aftward, seal sub-assembly 102 facilitates preventing disk spacer arm 48 from rotating against backing plate 104 or the brazing material. As such, seal sub-assembly 102 facilitates reducing engine disk bursts.

The above-described nozzle assemblies are cost-effective and highly reliable. Each nozzle assembly includes a nozzle flange that includes a plurality of semi-circular recesses that receive fasteners therethrough. A seal sub-assembly is coupled to each nozzle flange such that a mounting flange extends between the seal sub-assembly and the nozzle flange. The mounting flange mounts the seal back plate obliquely within the engine to facilitate preventing disk bursts following a shaft separation. Accordingly, the above-described nozzle assemblies facilitate extending a useful life of the rotor assembly in a cost-effective and reliable manner.

While the invention has been described in terms of various specific embodiments, those skilled in the art will recognize that the invention can be practiced with modification within the spirit and scope of the claims.

What is claimed is:

1. A method for fabricating a nozzle assembly for a gas turbine engine rotor assembly, the rotor assembly including at least two adjacent rows of rotor blades coupled together by a disk spacer arm, said method comprising:

providing a nozzle assembly that includes at least one nozzle including a blade that extends outwardly from a radially outer side of a platform;

coupling the nozzle assembly into the rotor assembly between the two adjacent rows of rotor blades; and coupling a seal assembly that includes a backing piece to the nozzle assembly such that the backing piece is substantially parallel to the rotor assembly disk spacer arm, the disk spacer arm is oblique with respect to an axis of rotation of the rotor assembly to facilitate reducing engine disk bursts.

2. A method in accordance with claim 1 wherein coupling the seal assembly that includes a backing piece to the nozzle assembly further comprises coupling the seal assembly to a nozzle flange that extends from a radially inner side of the nozzle platform, wherein the nozzle flange includes a plurality of openings that extend therethrough.

3. A method in accordance with claim 2 wherein coupling the seal assembly that includes a backing piece to the nozzle assembly further comprises coupling the seal assembly to a mounting flange such that the mounting flange is coupled between the seal assembly backing piece and the nozzle assembly nozzle flange.

4. A method in accordance with claim 3 wherein coupling the seal assembly to a mounting flange further comprises coupling a seal assembly having at least one of a substantially U-shaped cross-sectional profile and a tapered cross-sectional profile to the nozzle flange.

5. A method in accordance with claim 2 wherein coupling a seal assembly that includes a backing piece to the nozzle assembly further comprises coupling a seal assembly to the nozzle assembly that facilitates preventing rubbing between the seal assembly and the rotor assembly following a mid shaft separation within the rotor assembly.

6. A rotor assembly for a gas turbine engine, said rotor assembly comprising:

a rotor comprising a rotor shaft and a plurality of rows of rotor blades, wherein adjacent rows of rotor blades are coupled by a disk spacer arm, the disk spacer arm is oblique with respect to a centerline extending through the gas turbine engine to facilitate reducing engine disk bursts; and a nozzle assembly extending between adjacent rows of said plurality of rotor blades, each said nozzle assembly comprising a nozzle comprising a blade extending outwardly from a platform, and an interstage seal assembly, each said seal assembly coupled to said nozzle platform and comprising a backing piece, said backing piece substantially parallel to said disk spacer arm.

7. A rotor assembly in accordance with claim 6 wherein each said seal assembly coupled by a nozzle flange to each said nozzle platform, said nozzle flange comprising a plurality of openings extending therethrough.

8. A rotor assembly in accordance with claim 7 wherein each said seal assembly backing piece brazed to said nozzle flange such that a mounting flange extends between said backing piece and said nozzle flange.

9. A rotor assembly in accordance with claim 8 wherein each said seal assembly mounting flange has a substantially U-shaped cross sectional profile.

10. A rotor assembly in accordance with claim 8 wherein each said seal assembly mounting flange is tapered.

11. A rotor assembly in accordance with claim 7 wherein said nozzle flange comprises a plurality of semi-circular fastener recesses.

12. A rotor assembly in accordance with claim 7 wherein said seal assembly configured to facilitate minimizing rubbing between said seal assembly and said disk spacer arm following a mid shaft separation.

13. A gas turbine engine comprising at least one turbine comprising a rotor assembly and a nozzle assembly, said rotor assembly comprising a rotor shaft and at least two adjacent of rows of rotor blades coupled by a disk spacer arm, the disk spacer arm is oblique with respect to a centerline extending through the gas turbine engine to facilitate reducing engine disk bursts, said nozzle assembly between said adjacent rows of rotor blades, said nozzle assembly comprising a nozzle comprising a blade extending outwardly from a platform, and a seal sub-assembly, said seal sub-assembly comprising a backing piece coupled to said nozzle platform such that said backing piece substantially parallel to said disk spacer arm.

14. A gas turbine engine in accordance with claim 13 wherein said nozzle assembly further comprises a nozzle flange coupled to said nozzle platform, said nozzle flange comprising a plurality of semi-circular recesses.

15. A gas turbine engine in accordance with claim 14 wherein said seal sub-assembly further comprises a mounting flange configured to mount between said seal sub-assembly backing piece and said nozzle flange.

16. A gas turbine engine in accordance with claim 15 wherein said seal sub-assembly further comprises a mounting flange having a substantially U-shaped cross-sectional profile, said mounting flange brazed to said seal assembly and said nozzle flange.

17. A gas turbine engine in accordance with claim 15 wherein said seal sub-assembly further comprises a tapered mounting flange brazed to said seal assembly and said nozzle flange.

18. A gas turbine engine in accordance with claim 15 wherein said seal sub-assembly backing piece configured to facilitate minimizing rubbing between said rotor assembly and said seal assembly.

19. A gas turbine engine in accordance with claim 15 wherein said seal sub-assembly further comprises a honeycomb seal coupled to said backing piece.

* * * * *

UNITED STATES PATENT AND TRADEMARK OFFICE

CERTIFICATE OF CORRECTION

PATENT NO. : 6,729,842 B2
DATED : May 4, 2004
INVENTOR(S) : Drerup et al.

It is certified that error appears in the above-identified patent and that said Letters Patent is hereby corrected as shown below:

Column 7,
Line 16, delete "adjacent of rows" and insert therefor -- adjacent rows --.

Signed and Sealed this

Sixth Day of September, 2005

JON W. DUDAS
*Director of the United States Patent and Trademark Office*